US009889573B2

(12) United States Patent
Singer

(10) Patent No.: US 9,889,573 B2
(45) Date of Patent: Feb. 13, 2018

(54) KNIFE WITH GRIP

(71) Applicant: Norman Singer, Beit Shemesh (IL)

(72) Inventor: Norman Singer, Beit Shemesh (IL)

( * ) Notice: Subject to any disclaimer, the term of this patent is extended or adjusted under 35 U.S.C. 154(b) by 94 days.

(21) Appl. No.: 14/752,032

(22) Filed: Jun. 26, 2015

(65) Prior Publication Data

US 2016/0375598 A1 Dec. 29, 2016

(51) Int. Cl.
*B26B 29/02* (2006.01)
*B26B 3/00* (2006.01)

(52) U.S. Cl.
CPC ..... *B26B 29/02* (2013.01); *B26B 3/00* (2013.01)

(58) Field of Classification Search
CPC ..... B26B 29/02; B26B 3/00
USPC ..... 30/295; D7/649
See application file for complete search history.

(56) References Cited

U.S. PATENT DOCUMENTS

| | | | |
|---|---|---|---|
| 108,141 | A | 10/1870 | Houseman et al. |
| 165,841 | A | 7/1875 | Kellogg |
| 173,955 | A | 2/1876 | Hudson |
| 226,146 | A | 3/1880 | Zimmerer |
| 235,425 | A | 12/1880 | Gearon |
| 296,304 | A | 4/1884 | Allen |
| 369,314 | A | 9/1887 | Brougher |
| 391,268 | A | 10/1888 | Parker |
| 490,577 | A | 1/1893 | Memminger |
| 492,409 | A | 2/1893 | May |
| D22,439 | S | 5/1893 | McGuigan |
| 538,459 | A | 4/1895 | McCausland |
| 605,577 | A | 6/1898 | Hutchinson |
| 649,059 | A | 5/1900 | Kern |
| 673,506 | A | 5/1901 | Pitts |
| 682,624 | A | 9/1901 | Klickman |
| 682,938 | A | 9/1901 | Ingram |
| 725,811 | A | 4/1903 | Asbell |
| 983,736 | A | 2/1911 | Maconoghie |
| 1,118,507 | A | 11/1914 | Meyer |

(Continued)

FOREIGN PATENT DOCUMENTS

| | | |
|---|---|---|
| CN | 2052708 U | 2/1990 |
| CN | 201573219 U | 9/2010 |

(Continued)

OTHER PUBLICATIONS

Hilton Knife, http://www.candlepowerforums.com/vb/showthread.php?343017-Another-Spyderco-paramilitary-2-review, Aug. 23, 2012.

(Continued)

*Primary Examiner* — Hwei C Payer
(74) *Attorney, Agent, or Firm* — Pearl Cohen Zedek Latzer Baratz LLP

(57) ABSTRACT

A grip for a knife, the knife characterized by a handle, a blade, a blade spine, and a blade edge, said grip comprising a forefinger grip located on a first face of the blade, said forefinger grip comprising a first forefinger guide, a second forefinger guide, and a forefinger retaining area configured to retain a first portion of a forefinger of a user; a thumb grip located on the second face of the blade, said thumb grip comprising a thumb guide and a thumb retaining area configured to retain a thumb of the user; and a platform located on the blade spine, said platform configured to provide support for a second portion the forefinger of the user.

21 Claims, 4 Drawing Sheets

(56) References Cited

U.S. PATENT DOCUMENTS

| | | | | |
|---|---|---|---|---|
| 1,299,084 | A | 4/1919 | Wilson | |
| 1,333,960 | A | 3/1920 | Brehm | |
| 1,491,623 | A | 4/1924 | Pitchur | |
| 1,505,444 | A | 8/1924 | Swanson | |
| 1,571,886 | A | 2/1926 | North | |
| 1,602,032 | A | 10/1926 | March | |
| 1,750,577 | A | 3/1930 | De Bracht | |
| 1,967,479 | A | 7/1934 | Platts | |
| 2,153,759 | A | 4/1939 | Katzinger | |
| 2,168,237 | A | 8/1939 | Polacsek | |
| 2,217,100 | A | 10/1940 | Burns | |
| D131,224 | S | 1/1942 | Parisi | |
| 2,279,833 | A | 4/1942 | Madan | |
| 2,315,898 | A | 4/1943 | Krilow | |
| D136,023 | S | 7/1943 | Phillips | |
| 2,467,327 | A | 4/1949 | McKee | |
| 2,494,306 | A | 1/1950 | Morvey | |
| D173,124 | S | 9/1954 | Niblack | |
| 2,737,719 | A | 3/1956 | Ember et al. | |
| 2,739,498 | A | 3/1956 | Champlin | |
| D177,743 | S | 5/1956 | Marx | |
| 2,803,876 | A | 8/1957 | Nelson | |
| D202,780 | S | 11/1965 | Baer | |
| D235,841 | S | 7/1975 | Cremonese | |
| D239,623 | S | 4/1976 | Behunin | |
| D252,790 | S | 9/1979 | Reinschreiber | |
| 4,178,684 | A | 12/1979 | Mightly | |
| D255,974 | S | 7/1980 | Jacoby | |
| D262,731 | S | 1/1982 | Austin | |
| 4,578,864 | A | 4/1986 | Hoffman | |
| D306,957 | S | 4/1990 | Cohen et al. | |
| 5,365,666 | A | 11/1994 | Gonzalez | |
| D391,115 | S | 2/1998 | Roberton | |
| D397,282 | S | 8/1998 | Derkatz | |
| D405,338 | S | 2/1999 | Balolia | |
| D439,806 | S | 4/2001 | Juhlin et al. | |
| D445,643 | S | 7/2001 | Kazaklaris | |
| D461,681 | S | 8/2002 | Lothe | |
| D461,688 | S | 8/2002 | Lothe | |
| 6,502,314 | B1 * | 1/2003 | McCatty | B25G 1/102 16/430 |
| 6,725,545 | B2 | 4/2004 | Frank | |
| D537,850 | S | 3/2007 | Moore et al. | |
| D538,591 | S | 3/2007 | Ashton, III | |
| D552,430 | S | 10/2007 | Chen | |
| D554,949 | S | 11/2007 | Hood | |
| 7,302,760 | B2 | 12/2007 | Lake | |
| 7,434,320 | B2 * | 10/2008 | Aston, III | B26B 29/02 30/295 |
| D600,506 | S | 9/2009 | Miltner et al. | |
| D612,694 | S | 3/2010 | Eide et al. | |
| D643,256 | S | 8/2011 | Hirai | |
| D643,257 | S | 8/2011 | Hirai | |
| D643,260 | S * | 8/2011 | Spiegel | D7/649 |
| 8,082,669 | B2 | 12/2011 | Hayes | |
| 8,584,365 | B2 | 11/2013 | Zeitlin | |
| 8,732,958 | B2 | 5/2014 | Huang | |
| D643,261 | S | 8/2014 | Spiegel | |
| D719,405 | S | 12/2014 | Miller | |
| 8,931,381 | B2 | 1/2015 | Poran | |
| 8,943,935 | B2 | 2/2015 | Qian | |
| 9,132,559 | B2 * | 9/2015 | Hatch | B26B 3/00 |
| D774,354 | S | 12/2016 | Scobey, Jr. | |
| 2002/0170184 | A1 | 11/2002 | Lothe | |
| 2003/0182808 | A1 | 10/2003 | Mireles | |
| 2005/0241111 | A1 * | 11/2005 | Prokop | B25G 1/102 16/430 |
| 2013/0104403 | A1 * | 5/2013 | Stokes | B26B 3/00 30/165 |
| 2016/0193742 | A1 * | 7/2016 | Faiola | B26B 3/00 30/298 |
| 2016/0375598 | A1 * | 12/2016 | Singer | B26B 3/00 30/295 |

FOREIGN PATENT DOCUMENTS

| | | | |
|---|---|---|---|
| DE | 29914226 | U1 | 11/1999 |
| KR | 20090007796 | U | 8/2009 |

OTHER PUBLICATIONS

Jade Knife, http://andy321.proboards.com/thread/50295/jade-knife, Feb. 1, 2012.

Tac-Force TF-578BK Karambit A/O Finger Ring Knife, http://www.moosecreekgear.com/tac-force-tf578bk-karambit-ao-linerlock-knife.html, last accessed Jun. 25, 2015.

Gerber Myth Pocket Folder Knife, http://www.amazon.com/Gerber-Myth-Pocket-Folder-Knife/dp/B00P6M07B4, last accessed Jun. 25, 2015.

High Desert Survival School Knife, http://jasonklass.blogspot.in/2011/05/high-desert-survival-school-knife.html, last accessed Jun. 25, 2015.

Restriction Requirement for U.S. Appl. No. 29/549,728, dated Feb. 10, 2017.

Notice of Allowance for U.S. Appl. No. 29/548,734, dated Jan. 27, 2017.

Notice of Allowance for U.S. Appl. No. 29/548,770, dated Jan. 27, 2017.

Notice of Allowance for U.S. Appl. No. 29/548,797, dated Jan. 27, 2017.

* cited by examiner

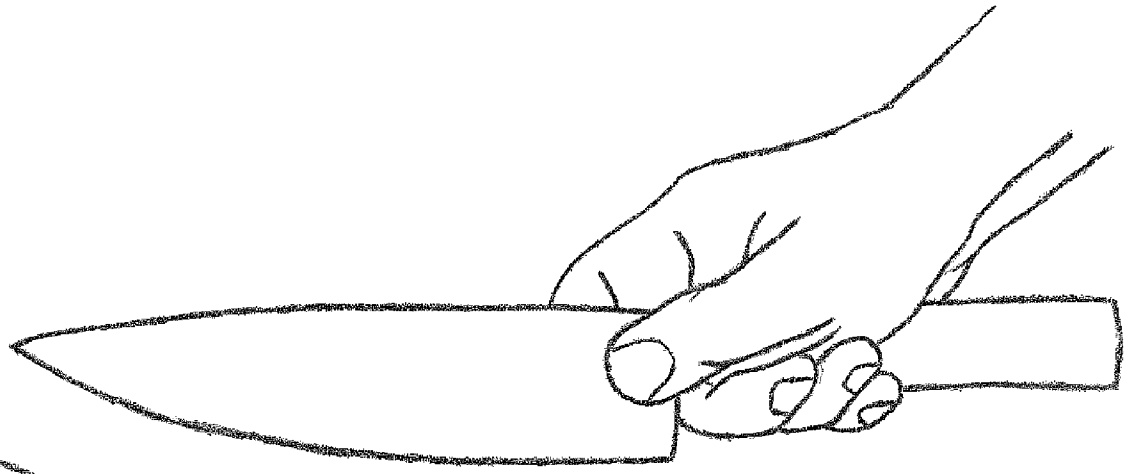
FIG. 2A
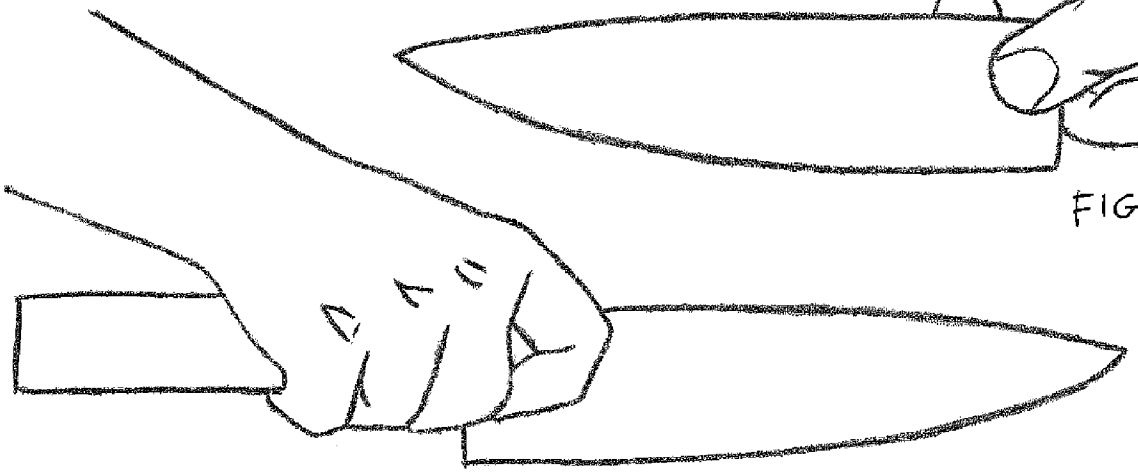
FIG. 2B
FIG. 2
PRIOR ART

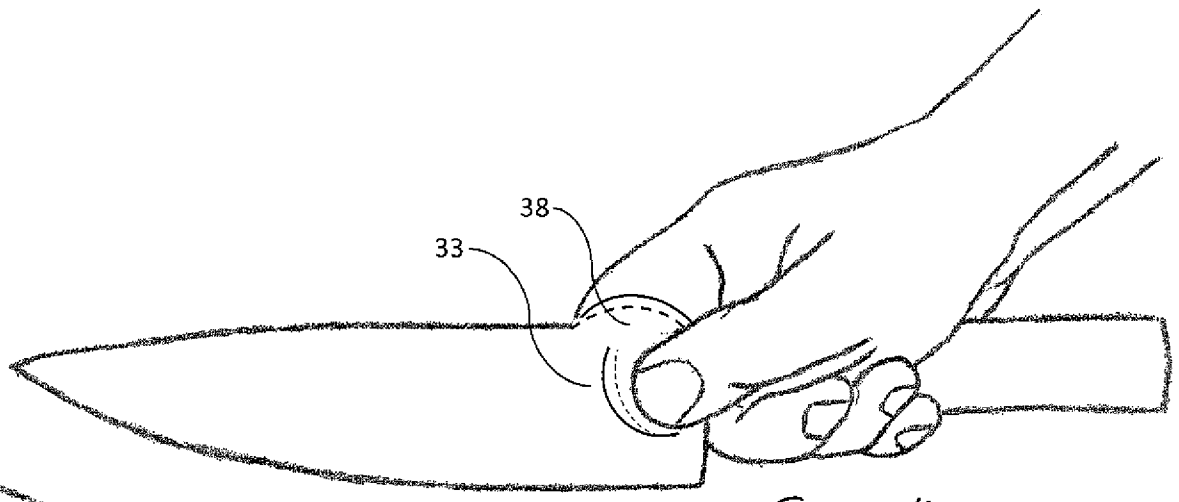
FIG. 4A
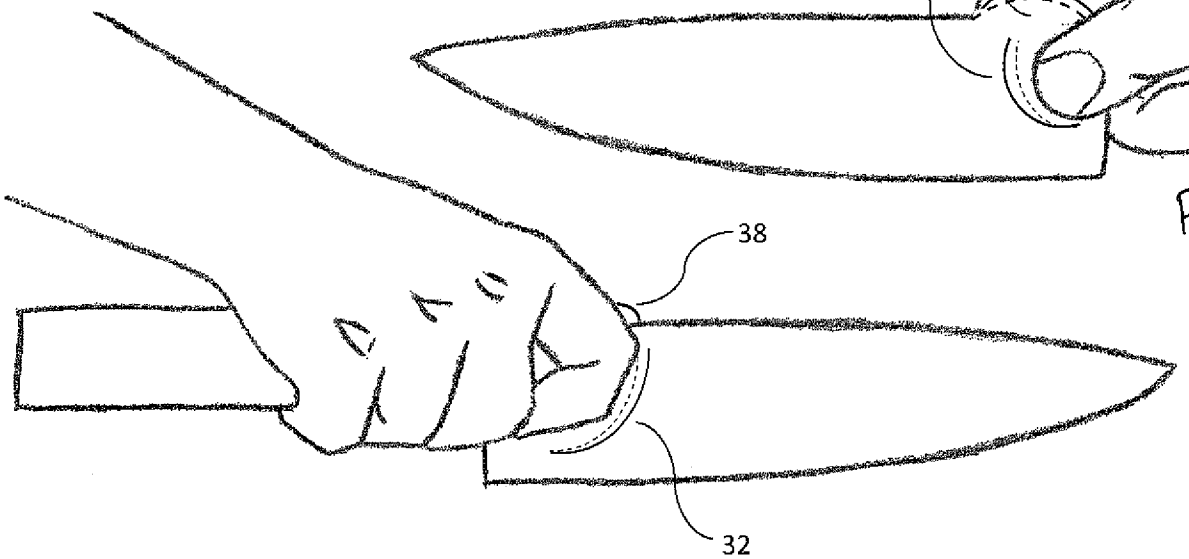
FIG. 4B
Fig. 4

KNIFE WITH GRIP

FIELD OF THE INVENTION

The present invention relates generally to the field of handheld tools, such as knives, and more particularly to a system and apparatus for improving the maneuverability, grip, and control of a handheld tool such as a knife.

BACKGROUND OF THE INVENTION

The safe and effective use of handheld tools such as knives requires a firm grip and precise control, and the ability to control the motion of a knife has a direct effect upon its safety and usefulness. Control and precision are especially important when using a knife or other sharp tool in an environment where a risk of injury is present, such as when used by chefs and others in the culinary arts.

Handle designs for knives have evolved over the years to provide the user with improved control. Features such as finger grips and curved handle shapes have improved the grip of various types of knives. Many knives, for example, include a bolster or guard at the end of the handle, next to the blade, to prevent the user's hand from slipping onto the blade during use. Other knife designs include a small platform on the top of the bolster or spine of the knife for placing the user's forefinger, which enables the user to apply a greater downward cutting force. Such platforms, however, assist the user only when pressing the knife in the downward direction. Additionally, the forefinger typically needs to stretch to its full extension in order to rest on the platform, which may cause stress to the joints with extended use.

Advanced cutting techniques have also evolved in order to improve the utility and safety of knives. For example, because many tasks in the culinary arts require precise control of a handheld tool, chefs sometimes pinch the back edge of a knife blade with their thumbs and forefingers when chopping or dicing foods. In doing so, the user places the thumb and forefinger on the back edge of the knife blade while continuing to rest the palm and remaining three fingers on the handle. However, gripping the back edge of a knife can cause discomfort for some users, even causing blisters or sores on the side of the forefinger that is pressed against back edge of the knife. Also, because the blade is flat and provides no support or grip, the fingers can easily slip, especially when wet or oily from food preparation, thus reducing control and potentially causing injury.

Knives have been modified in the past to improve the user's grip on the blade. For example, U.S. Pat. No. 7,302,760, entitled FOLDING KNIFE WITH DUAL-ACTION PISTON, describes a folding knife that has small notches near the base of the blade as well as a thumb tick with finger serrations on the spine of the blade to assist a user in opening and closing the knife. However, the sole purpose of these features is to assist the user with the minor movements of pinching the knife blade and extending or closing the folding knife blade, not for gripping the knife during use. Due to the small structure of the folding knife, the notches and thumb tick are designed to be gripped by a user's fingertips only, and these features are not suitable for extended use or for more strenuous use, such as when the user is chopping or dicing foods.

Chinese Patent Application Publication No. 201573219, entitled GRIP-HOLE TYPE DAILY KNIFE, describes a knife that has several holes near the base of the blade through which the user's fingers may be inserted to help grip the knife. However, inserting fingers through the knife blade to grip the knife itself can cause discomfort for some users, even causing blisters or sores on the parts of the fingers that are pressed against narrow internal edge of the knife.

U.S. Patent Application Publication No. 2002/0170184, entitled CONTROL SYSTEM FOR A HANDHELD TOOL, describes a control knob disposed on the back edge of the knife shaft or blade, and spaced apart from the handle, to create a finger gap, and describes methods including grasping the control knob and/or grasping the finger gap while loosely cradling the tool handle. However, the control knob may be inadequate to accurately control the motion of the knife during hasty food preparation because the fingers can slip off the ball just as easily as slipping off the blade of the knife. In addition, the control knob may get separated from the knife and lost, thus rendering its advantages useless.

U.S. Pat. No. 673,506, entitled GRIPPING HANDLE FOR TOOLS, describes a removable molded attachment to be disposed on the back edge or spine of a knife, which may be firmly grasped in the hand and against which a considerable amount of pressure may be exerted without tiring the fingers of the operator. The attachment may be hollowed out on one side to receive the user's thumb and may have a projection on the other side about which the user's forefinger may be bent during gripping by the user. However, this attachment may negatively impact the utility of the tool by interfering with space constraints, and colliding with large food items during a slicing and/or cutting motion. In addition, the attachment may get separated from the knife and lost, thus rendering its advantages useless. Moreover, when using this attachment, the user's forefinger proximal phalanx (e.g., the part of the forefinger closest to the palm/back of the hand) abuts an edge at the knife's spine, which may cause blisters or sores to form. Thus, the attachment described does not account for the placement of the user's forefinger proximal phalanx.

Similarly, U.S. Pat. No. 490,577, entitled POT SCRAPER, describes a pot scraper whose upper portion is thickened and has prongs projecting therefrom whose adjacent edges are beveled so that the user's forefinger and middle finger may be extended with ease between the prongs, thus giving the user a very secure hold on the scraper. However, the prongs jut out from the surface of the pot scraper and may negatively impact the utility of the tool. In addition, the prongs may make holding the scraper uncomfortable during use because the user's fingers constantly butt up against the prongs, which are designed not to comfortably hold the fingers but rather to maintain their position. Furthermore, this patent describes a three (3) finger grip for force, not a two (2) finger grip for control. Moreover, the grip described in this patent does not account for the placement of, or provide support for, the user's forefinger proximal phalanx.

U.S. Design Pat. No. D22,439, entitled TABLE KNIFE, illustrates a configuration for a table knife having a blade edge and a blade spine, wherein the blade spine includes a broadened and concave portion for the tip of a user's forefinger. However, this configuration does not include components that may facilitate a user gripping the knife blade with both thumb and forefinger on both faces of the knife's blade, and only contemplates placement of the tip of the user's forefinger, as opposed to the proximal phalanx, to aid the user in exerting a downward force on the knife blade.

Similarly, U.S. Pat. No. 492,409, entitled KNIFE, describes a finger support, rest, or guard for knives, including a padded clip that is bent into a shape so as to clip onto the spine of a knife. The top and inside surfaces of the clip include cushions of a soft material, and the user's finger rests upon the flat top of the clip. However, the clip does not include components that may facilitate a user gripping the knife blade with both thumb and forefinger on both faces of the knife's blade, and only contemplates placement of the user's forefinger, as opposed to the proximal phalanx, to aid the user in exerting a downward force on the knife blade. Moreover, the clip is an attachment that is manufactured separately from the knife and may get separated from the knife and lost, thus rendering its advantages useless.

In addition, U.S. Pat. No. 1,750,577, entitled KNIFE ATTACHMENT, describes a knife attachment having a spring clip for embracing the sides of the knife blade about the spine. The attachment includes spaced parallel jaws, oppositely outturned at their upper ends and formed lengthwise of the blade as a concaved surface, and further including along the top a central transversely convexed ridge, against the top face of which pressure is applied by the user's finger and which provides a longitudinally extending abutment that serves as a gripping surface for the finger. This attachment allows the forefinger's proximal phalanx to rest on the spine of the blade in a manner perpendicular to the blade but does not allow the forefinger to engage the face of the blade, thereby creating an awkward grip. Furthermore, the attachment is manufactured separately from the knife and may get separated from the knife and lost, thus rendering its advantages useless.

Accordingly, there is an unsatisfied need in the art for greater safety and greater control of a handheld knife beyond what is provided by the grips currently available in the art. Precision and speedy culinary tasks require a knife grip that facilitates a positive grip, clear visibility of the cutting region, significant leverage, no obstructions and greater control in all directions. It is desirable to achieve such goals with a knife grip formed as part of the knife which enables the user to comfortably hold the knife in a preferred manner when chopping or dicing foods, namely by pinching the back edge of the blade with the thumb and forefinger while resting the palm on the handle. None of the knife grip designs currently in the art meet these needs.

Thus, there is a need for a control system, or grip, for a handheld knife that provides a positive grip for safety, improved visibility of the cutting region, greater leverage for cutting power, and precise control in all directions. Such a control system would be useful for a variety of devices and handheld tools including utility and culinary knives.

SUMMARY OF THE INVENTION

Accordingly, it is an object of the present invention to provide a tool, such as a knife, having grip portions disposed on the base and/or the spine of the knife blade.

It is another object of the present invention to provide a knife having a grip that comfortably nestles the user's fingers. More specifically, it is the object of the present invention to provide a knife having a grip that comfortably nestles the user's thumb and forefinger in a form-fitting manner.

It is another object of the present invention to provide a knife having a grip located on the base of the knife and on spine of the knife, wherein the grip is configured to securely hold the user's thumb and forefinger and that allows the user to comfortably hold the knife by pinching the base of the blade with the thumb and forefinger while resting the palm and the remaining three fingers on the handle.

It is still another object of the present invention to provide a knife grip having at least one raised guide located on one face of the base of the blade, and at least one raised guide located on another, opposing, face of the base of the blade. In certain embodiments, the at least one raised guide on the first face of the blade is configured to confine, restrict and/or direct movement of a user's forefinger, while the at least one raised guide on the second face of the blade is configured to confine, restrict and/or direct movement of the user's thumb.

It is yet another object of the present invention to provide a knife grip having a first depression or fitted portion located on one face of the base of the blade, and a second depression or fitted portion located on another, opposing, face of the base of the blade. In certain embodiments, the first depression or fitted portion is configured to conform to, restrict or direct movement of a user's forefinger, while the second depression or fitted portion is configured to conform to, restrict or direct movement of the user's thumb.

It is a further object of the present invention to provide a knife grip having a third depression or fitted portion located on the spine of the blade above, in certain embodiments, the first and/or second depression. In certain embodiments, the third depression or fitted portion is configured to conform to a base/proximal portion of the user's forefinger. In certain embodiments, the spine is interrupted by the third depression, situated above the first and/or second depression, which creates a channel or platform to provide a rest for the proximal portion of the forefinger.

It is another object of the present invention to provide a grip for a handheld knife, the knife characterized by a handle, a blade having a first face and a second face opposing said first face, a blade spine, a blade edge and a front bolster, said grip comprising a forefinger grip located on the first face of the blade proximal to the front bolster, said forefinger grip comprising a first forefinger guide, a second forefinger guide, and a forefinger depression configured to hold a first portion of a forefinger of a user, said grip further comprising a thumb grip located on the second face of the blade proximal to the front bolster, said thumb grip comprising a thumb guide and a thumb depression configured to hold a thumb of the user, and said grip further comprising a forefinger platform located on the blade spine, said forefinger platform configured to hold a second portion the forefinger of the user.

It is a further object of the present invention to provide a handheld knife comprising a handle, a blade having a first face and a second face opposing said first face, a blade spine, a blade edge and a front bolster, and a grip comprising a forefinger grip located on the first face of the blade proximal to the front bolster, said forefinger grip comprising a first forefinger guide, a second forefinger guide and a forefinger depression configured to hold a first portion of a forefinger of a user, said grip further comprising a thumb grip located on the second face of the blade proximal to the front bolster, said thumb grip comprising a thumb guide and a thumb depression configured to hold a thumb of the user, and said grip further comprising a forefinger platform located on the blade spine, said forefinger platform configured to hold a second portion the forefinger of the user.

BRIEF DESCRIPTION OF THE DRAWINGS

The subject matter regarded as the invention is particularly pointed out and distinctly claimed in the concluding portion of this specification. The invention, however, both as to organization and method of operation, together with objects, features, and advantages thereof, may best be understood by reference to the following detailed descriptions when read with the accompanying drawings in which:

FIG. 2 shows an illustration, from a right-handed forehand view (FIG. 2A) and from a right-handed backhand view (FIG. 2B), of a user gripping a culinary knife with thumb and forefinger according to certain aspects of the prior art;

FIG. 4 is an illustration, from a right-handed forehand view (FIG. 4A) and from a right-handed backhand view (FIG. 4B), of a user gripping a culinary knife having a form-fitting grip according to certain aspects of the present invention;

Figure 1:
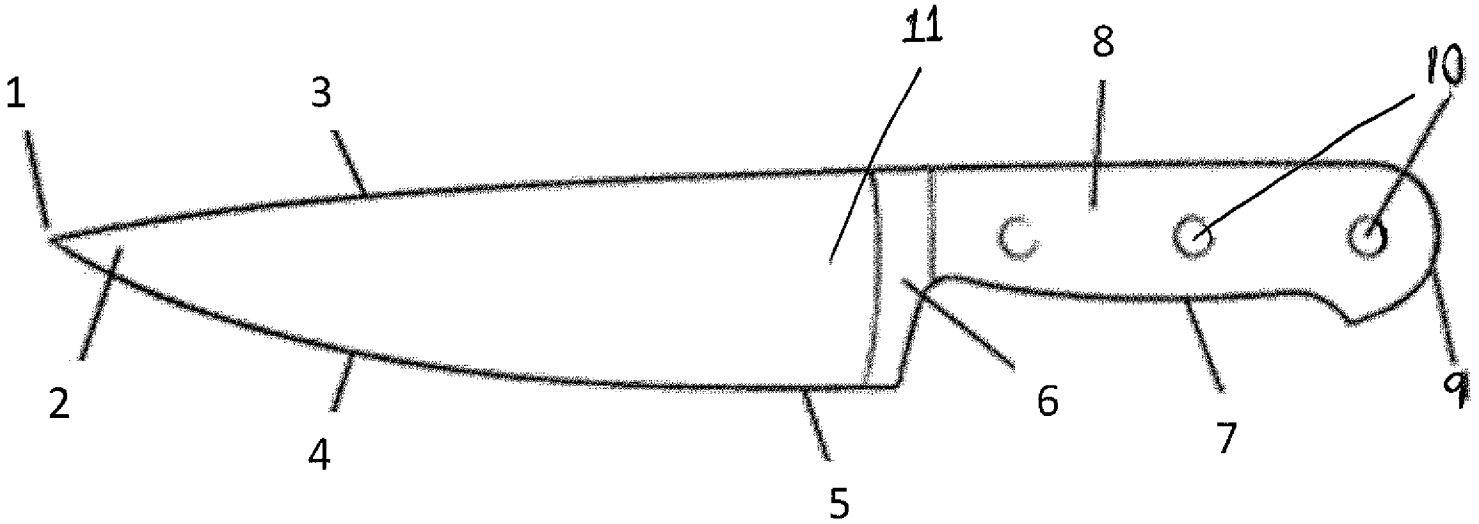
FIG. 1 PRIOR ART
FIG. 1 shows an illustration of a culinary knife according to certain aspects of the prior art.

It will be appreciated that for simplicity and clarity of illustration, elements shown in the figures have not necessarily been drawn to scale. For example, the dimensions of some of the elements may be exaggerated relative to other elements for clarity. Additionally, the many features of any one embodiment shown in a figure should not be considered independent and separate from the features of an embodiment shown in another figure, and it is conceivable that features of any one embodiment may be combinable with another. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those of ordinary skill in the art that the present invention may be practiced without these specific details. In other instances, well-known methods, procedures, and/or components have not been described in detail so as not to obscure the present invention.

Referring now to FIG. 1, a knife that is used in the culinary arts (e.g., a chef's knife) typically has a blade generally composed of a distal region or free end terminating in a tip (2) with a point (1), a proximal region having a base portion (11) with a heel (5), and a cutting region, between the proximal and distal regions, having a spine or back (3) opposing a cutting edge (4). A knife used in the culinary arts typically also has a handle generally composed of a tang (7) that extends from the blade and may be gripped by or encapsulated between slabs or scales (8), such as by rivets (10), and terminating at a butt (9). The knife may also have a bolster (6) situated between the blade and the handle. Other knife parts are contemplated, and each of the listed parts may have various sizes, shapes, weights, and/or configurations.

Generally, the spine (3) is the thickest, heaviest length of the blade and supports the entire blade. As the spine of the knife gets wider and thicker, the blade becomes stronger along its length. In many knives, the strongest portion of the blade is at the base region. Bolsters (e.g., front bolster (6)) are designed to strengthen the blade in critical areas, such as at the blade and handle junction, or at the rear or butt of the knife in the case of a rear bolster.

There are a variety of different ways to grip a knife during food preparation, and some grips are better for particular situations than others. For example, when chopping or slicing food items in what is known as "the chef's grip", a user may grip the knife by pinching the base (11) of the blade with the thumb and forefinger, while the remaining parts of the hand, namely the palm and other fingers, grip or cradle the knife handle. The chef's grip provides the user with better control over the knife and allows for a more precise cut.

FIG. 2 is an illustration of a knife being held using the chef's grip, viewed from both sides of the knife. As depicted in FIG. 2, the user's forefinger is placed against a first face of the base of the knife blade, and the user's thumb is placed against a second, opposing face, of the base of the knife blade, with the side of the user's forefinger pressed against the first face of the knife. In order for the user to apply downward pressure during cutting, the proximal phalanx of the user's forefinger extends across or rests against the spine of the knife, and the user's palm rests on the knife handle while the user's middle, ring and small fingers are curled (e.g., wrapped around) around the knife handle. FIG. 2A shows an illustration of this grip from a right-handed forehand view, and FIG. 2B shows an illustration of this grip from a right-handed backhand view.

In the chef's grip, the user's thumb and forefinger are held in place against the blade by friction based on the strength of the user's grip. When the blade becomes wet or oily, it can become slippery, thus requiring even greater strength, and a tighter grip, to maintain an adequate hold on, and control over, the knife. As the user pinches the bolster with greater force to prevent slippage, the user's thumb and forefinger may tire quickly. In addition, when this grip is used, blisters and sores may form on the proximal phalanx of the user's forefinger due to the downward pressure exerted during the chopping/slicing motions by the forefinger's proximal phalanx, which extends across or is pressed against the knife's spine (3), which typically has a squared edge despite being dull.

The knife grip according to the present invention is intended to cure the above deficiencies. Specifically, it is an object of the present invention to provide a knife having a grip that comfortably holds the user's thumb and forefinger, and prevents the thumb and forefinger from slipping on the knife, when the user is holding the knife in the chef's grip as shown in, for example, FIG. 2.

In certain embodiments, in order to prevent the thumb and forefinger from slipping on the knife blade, the grip of the present invention provides guides, depressions or fitted portions that may be formed on or in the knife's base (11), as depicted in FIG. 1, to securely hold the thumb and forefinger. In order to create the guides, depressions or fitted portions, in certain embodiments of the present invention, the knife's base (11) may have elongated projections to form guides. That is, additional material (e.g., ceramic or metal) may be added, such as by bonding, welding or drilling, to the two faces of the blade at its base (11), so as to project or bulge outward from each opposing surface of the knife blade to form elongated projections that are appropriately shaped or contoured, thereby forming guides or barriers (e.g., walls) that retain the thumb and forefinger within the contours of the elongated projections. These guides are shaped such that they conform to the contours of the thumb and forefinger held within them so as to provide a form-fitting grip.

In certain other embodiments, the knife's base (11) may have an enlarged shape into which fitted portions or depressions may be formed. In this embodiment, more material (e.g., ceramic or metal) is used to form the base (11) of the blade, such that in some embodiments portions of the base (11) may project or bulge outward from each opposing face of the knife blade. Fitted portions or depressions that hold the thumb and forefinger may be formed within the bulges, thereby creating depressed portions into the base (11) that are substantially shaped or contoured to conform to the thumb and forefinger, and retaining portions of the base that remain bulged outward from the side of the blade surface thereby form barriers (e.g., walls) that surround the depressed portions to retain the thumb and forefinger within the contours of the depressed portions. These retaining portions are shaped such that they conform to the contours of the thumb and forefinger held within the contours of the depressed portions so as to provide a form-fitting grip.

It is noted that, in certain embodiments, the guides that are added to the blade's surface, or the retaining portions of the base (11) of the blade that remain bulged from the blade surface, are sufficient to prevent movement of the thumb and forefinger from within the grip but themselves, generally, extend only a small distance from the blade surface. In this way, the guides or retaining portions (e.g., barriers or walls) do not negatively impact the utility of the tool by interfering with space constraints, and colliding with large food items during a slicing and/or cutting motion.

In certain other embodiments of the present invention, the base (11) of the blade does not require any extra material, and the fitted portions or depressions that are configured to hold the thumb and forefinger are formed directly into the surface of the blade at its base (11). In this embodiment, the blade still includes depressed portions as well as retaining portions surrounding the depressed portions, as described above. In this embodiment, the retaining portions extend an even smaller distance away from the surface of the base (11) of the blade.

Figure 3A:
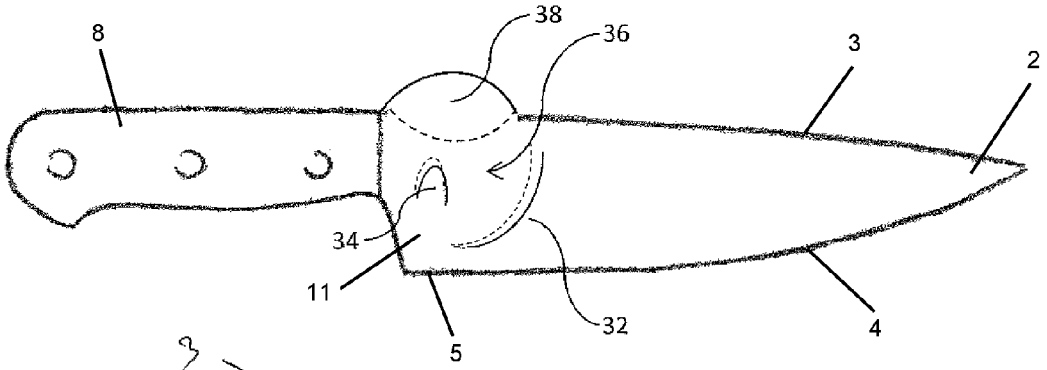
FIG. 3A is an illustration of one side (e.g., a first face) of a culinary knife having a form-fitting grip according to certain aspects of the present invention.

Reference is now made to FIG. 3A, which is an illustration of one side (e.g., a first face) of a knife whose blade has a grip according to certain aspects of the present invention. As depicted in FIG. 3A, when the blade is viewed from the right-handed backhand side, the grip includes an outside forefinger guide or wall (32) (e.g., a first guide or wall), an inside forefinger guide or wall (34) (e.g., a second guide or wall), and a proximal phalanx platform (38). The outside forefinger guide (32) and inside forefinger guide (34) project laterally away from the surface of the blade in a perpendicular (e.g., transverse or horizontal) direction relative to the surface of the knife blade (e.g., relative to the knife's longitudinal axis).

In a first embodiment, a forefinger retaining area (36) is formed between outside forefinger guide (32), inside forefinger guide (34) and proximal phalanx platform (38), and its surface may be the surface of the blade. In this embodiment, outside forefinger guide (32) and inside forefinger guide (34) are raised projections that may be formed on the base of the knife blade by the addition of material via bonding, welding or drilling onto the first face of the base (11) of the blade, thereby projecting outward from the first face of the knife blade to form elongated projections that are appropriately shaped or contoured to retain a forefinger within the contours of the elongated projections. The outside forefinger guide (32) and inside forefinger guide (34) are shaped such that they conform to the contours of the forefinger. In certain embodiments, forefinger retaining area (36) may include one or more indentations formed into the surface of the blade (i.e., the first face of the blade).

In an alternative embodiment, an enlarged shape or bulge of additional material may be placed on the blade's base (11). The additional material may be stamped or molded to form the portions of the base that project or bulge outward from the face of the knife blade such as, for example, outside forefinger guide (32) and inside forefinger guide (34). The forefinger retaining area (36) of the blade between outside forefinger guide (32), inside forefinger guide (34) and proximal phalanx platform (38) may be formed into the additional material or bulge, thereby creating a depressed portion on the knife base (11) that is substantially shaped or contoured (e.g., configured) to conform to the contours of a forefinger. In this way, outside forefinger guide (32), inside forefinger guide (34) and proximal phalanx platform (38) surround the forefinger retaining area (36). Forefinger retaining area (36) may also be, generally, a substantially flattened portion of the blade.

In certain embodiments, such as shown in FIG. 3A, outside forefinger guide (32) may extend on the base of the knife's blade from the knife heel to the knife spine. In preferred embodiments, outside forefinger guide (32) has a curved shape. Preferably, the curve of outside forefinger guide (32) is concave generally in a direction facing the knife handle and convex in a direction facing the knife blade edge (4) and tip (2), such as illustrated in FIG. 3A. In this way, the curvature of outside forefinger guide (32) is configured to conform to the contours of the upper surface of the user's forefinger when the forefinger is bent in a position for holding the knife in the chef's grip (as shown in, for example, FIGS. 2B and 4B). As a result, in certain embodiments, as shown in FIG. 4B, the curvature of the surface of outside forefinger guide (32) adjacent to area (36) is configured to match the curvature (e.g., bend or contours) of the upper surface of the middle and distal phalanxes of the forefinger.

In certain embodiments, such as shown in FIG. 3A, inside forefinger guide (34) may be located adjacent to outside forefinger guide (32), proximal to the knife handle, and separated by a gap, which forms part of forefinger retaining area (36). In certain embodiments, inside forefinger guide (34) is curved, and the curve of inside forefinger guide (34) is concave generally in a direction facing the knife heel (5) and cutting edge (4), and convex in a direction facing the knife spine (3). In this way, the curvature of the inside forefinger guide (34) is configured to conform to the contours of the tip of a forefinger when the forefinger is in a bent position for holding the knife in the chef's grip (as shown in, for example, FIGS. 2B and 4B). As a result, in certain embodiments, the curvature of the surface of inside forefinger guide (34) is configured to match the curvature of the tip of the distal, phalanx of the forefinger.

In certain embodiments, outside forefinger guide (32) and inside forefinger guide (34) may be continuous or merge. In this way, outside forefinger guide (32) and inside forefinger guide (34) may be formed as one piece. Other configurations are also possible.

As discussed above, outside forefinger guide (32) and inside forefinger guide (34) project away from the surface of the knife blade, generally in a direction perpendicular (e.g., transverse or horizontal) to the longitudinal axis of the knife and to the surface of the blade of the knife. In this way, outside forefinger guide (32) and inside forefinger guide (34) form barriers adapted to prevent movement of the forefinger during use. For example, outside forefinger guide (32) may be configured to keep the user's forefinger within forefinger retaining area (36), or within an indentation within area (36), and to prevent movement of the forefinger in a direction towards the knife's tip (2) as well as prevent movement of the forefinger in a direction towards the knife's cutting edge (4). Inside forefinger guide (34) may be configured to prevent movement of the forefinger in a direction towards the knife's cutting edge (4) and heel (5).

The height that outside forefinger guide (32) and inside forefinger guide (34) project away from the surface of the blade is sufficient to prevent forefinger movement, but not too large so as to create a burden when using the tool. In certain embodiments, the height of outside forefinger and inside forefinger guides (32),(34) may be from 1 mm to 1 cm. In other embodiments, this height may be between 3 mm and 7 mm. In yet other embodiments, this height may be from 4 mm to 6 mm. In certain embodiments, outside forefinger guide (32) may have a height that is greater than the height of inside forefinger guide (34). This is because, in certain embodiments, outside forefinger guide (32) may be the primary wall preventing forefinger movement.

As discussed above, and as illustrated in FIG. 3A, outside forefinger guide (32) and inside forefinger guide (34) enclose forefinger retaining area (36) between them. In preferred embodiments, forefinger retaining area (36) is configured to hold the user's forefinger when the user is holding the knife with the chef's grip. As a result, forefinger retaining area (36) may have a curvature complementary to the curvature of the outside and inside forefinger guides (32),(34). In certain embodiments, the bottom of forefinger retaining area (36) may be the surface of the knife blade, in which case forefinger retaining area (36) would be relatively flat. In certain embodiments, forefinger retaining area (36) may include one or more indentations formed into the surface of the blade (i.e. the first face of the blade).

In an alternative embodiment, forefinger retaining area (36) may be formed from additional material located on the knife base (11). The additional material or bulge may be stamped or molded to form outside and inside forefinger guides (32),(34), respectively, as well as forefinger retaining area (36) therebetween. In this embodiment, the additional material (e.g., ceramic or metal) forming forefinger retaining area (36) may connect inside forefinger guide (34), outside forefinger guide (32) and proximal phalanx platform (38) such that inside forefinger guide (34), outside forefinger guide (32), forefinger retaining area (36), and proximal phalanx platform (38) are formed as one piece. In this latter embodiment, it is conceivable that the surface of the knife within forefinger retaining area (36) may have a substantially curved surface such that forefinger retaining area (36) is configured to conform to the contours of the forefinger. A curved bottom surface in forefinger retaining area (36) may be more comfortable for a user and may help to further improve how the forefinger rests between the outside forefinger and inside forefinger guides (32),(34). Embodiments in which each component is a separate piece are also contemplated such as, for example, the embodiments discussed above wherein the guides are bonded, welded or bolted to the knife base.

In certain embodiments, forefinger retaining area (36) may have a texturized or stippled surface to increase the coefficient of friction of the blade where contacted by the user's fingers and aid the user in gripping the knife and preventing the user's fingers from slipping. The texturized or stippled surface may be stamped onto forefinger retaining area (36) or otherwise formed during the manufacturing process. However, in other embodiments, forefinger retaining area (36) prevents any finger movement on the blade without the need for any texturized or stippled surface.

Figure 3D:
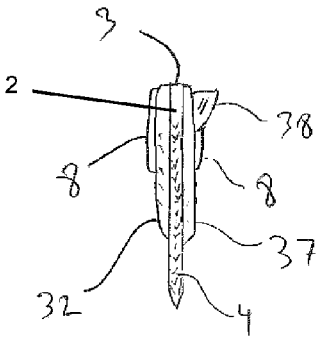
FIG. 3D is an illustration of a front view of a culinary knife having a form-fitting grip according to certain aspects of the present invention.
Figure 3B:
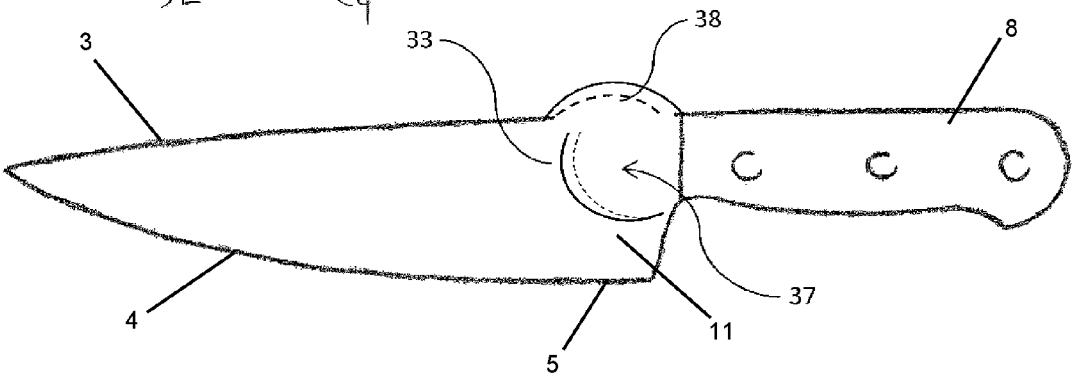
FIG. 3B is an illustration of another side (e.g., a second face) of a culinary knife having a form-fitting grip according to certain aspects of the present invention.

Reference is now made to FIG. 3B, which is an illustration, when viewed from the right-handed forehand side (e.g., a second face), of a knife whose blade has a form-fitting grip according to certain aspects of the present invention. As depicted in FIG. 3B, the portion of the grip on the second face of the blade includes a thumb guide (33). The thumb side of proximal phalanx platform (38) is also shown in FIG. 3B and corresponds to the underside surface of proximal phalanx platform (38). Similar to outside forefinger and inside forefinger guides (32),(34) on the backhand side of the blade, thumb guide (33) projects laterally away from the surface of the blade in a perpendicular (e.g., transverse or horizontal) direction relative to the surface of the knife blade (e.g., relative to the knife's longitudinal axis).

On the forehand side of the grip of the present invention, a thumb retaining area (37) is formed between the thumb guide (33), the underside of (or adjacent to) proximal phalanx platform (38) and the knife handle (or bolster (6), shown in FIG. 1, if present). In certain embodiments, the surface of thumb retaining area (37) may be the normal surface of the blade. In this embodiment, thumb guide (33) is a raised projection that may be formed on the base of the knife blade by the addition of material via bonding, welding, drilling or bolting onto the second face of the base (11) of knife blade, thereby projecting outward from the second face of the knife blade to form an elongated projection that is appropriately shaped or contoured to retain a thumb within the contours of the elongated projection. The thumb guide (33) is shaped such that it conforms to the contours of the thumb. In certain embodiments, thumb retaining area (37) may include one or more indentations formed into the surface of the blade (i.e., the second face of the blade).

In an alternative embodiment, an enlarged shape or bulge of additional material may be placed on the blade's base (11). The additional material may be stamped or molded to form the portion of the base that projects or bulges outward from the face of the knife blade such as, for example, thumb guide (33). The thumb retaining area (37) of the blade between thumb wall (33), the underside surface of proximal phalanx platform (38) and the knife handle may be formed into the additional material or bulge, thereby creating a depressed portion of the base (11) that is substantially shaped or contoured (e.g., configured) to conform to the contours of the thumb. In this way, thumb guide (33), the underside surface of proximal phalanx platform (38), and the knife handle surround the thumb retaining area (37). Thumb retaining area (37) may also be, generally, a substantially flattened portion of the base (11) of the blade.

In certain embodiments, such as shown in FIG. 3B, thumb guide (33) may extend on the base of the knife's blade from the knife heel to the knife spine. Because only the distal phalanx, i.e., the tip, of the user's thumb is used to grip the knife in the chef's grip, the thumb guide (33) is generally located in an area closer to the knife spine, rather than in an area closer to the cutting edge. In preferred embodiments, thumb guide (33) has a curved shape. Preferably, the curve of thumb guide (33) is concave generally in a direction facing the knife handle and convex in a direction facing the knife blade edge (4) and tip (2), such as illustrated in FIG. 3B. In this way, the curvature of thumb guide (33) is configured to conform to the contours of the top and sides of the user's thumb when the thumb is in a position for holding the knife in the chef's grip (as shown, for example, in FIGS. 2A and 4A). As a result, in certain embodiments, as shown in FIG. 4A, the curvature of thumb guide (33) is configured to match the contour of the outward surface of the thumb (e.g., the contour of the thumb's distal phalanx).

As discussed above, thumb guide (33) projects away from the surface of the knife blade, generally in a direction perpendicular (e.g., transverse or horizontal) to the longitudinal axis of the knife and to the surface of the blade of the knife. In this way, thumb guide (33) forms a barrier adapted to prevent thumb movement during use. For example, thumb guide (33) may be configured to keep the user's thumb within thumb retaining area (37) and to prevent thumb movement in a direction towards the knife's cutting edge (4) and heel (5).

The length and/or extension of thumb guide (33) is sufficient to prevent excess thumb movement, but not too large so as to create a burden when using the knife. In certain embodiments, the length of thumb guide (33) may be from 1 cm to 6 cm long, or, more preferably, from 2 cm to 5 cm long. In certain embodiments, thumb guide (33) may project away from the surface of the blade approximately 0.25 cm to 1.5 cm, or, more preferably, approximately 1 cm.

The height that thumb guide (33) projects away from the surface of the blade is sufficient to prevent thumb movement, but not too large so as to create a burden when using the tool. In certain embodiments, the height of thumb guide (33) may be from 1 mm to 1 cm. In other embodiments, this height may be between 3 mm and 7 mm. In yet other embodiments, this height may be from 4 mm to 6 mm.

As discussed above, and as illustrated in FIG. 3B, thumb guide (33), the underside surface of proximal phalanx platform (38), and the knife handle enclose thumb retaining area (37) between them. In preferred embodiments, thumb retaining area (37) is configured to hold the user's thumb when the user is holding the knife with the chef's grip. As a result, thumb retaining area (37) may have a curvature complementary to the curvature of the thumb guide (33). In certain embodiments, the bottom of thumb retaining area (37) may be the surface of the knife blade, in which case thumb retaining area (37) would be relatively flat. In certain embodiments, thumb retaining area (37) may include one or more indentations formed into the surface of the blade (i.e., the second face of the blade).

In an alternative embodiment, thumb retaining area (37) may be formed from additional material located on the knife base (11). The additional material or bulge may be stamped or molded to form the thumb guide (33) as well as thumb retaining area (37) therebetween. In this embodiments, the additional material (e.g., ceramic or metal) forming thumb retaining area (37) may connect thumb guide (33) and the underside surface of proximal phalanx platform (38) such that thumb guide (33) and the underside surface of proximal phalanx platform (38) are formed as one piece. In this latter embodiment, it is conceivable that the surface of the knife within thumb retaining area (37) may have a substantially curved surface such that thumb retaining area (37) is configured to conform to the contours of the thumb surface. A curved bottom surface in thumb retaining area (37) may be more comfortable for a user and may help to further improve how the thumb rests between the thumb guide (33) and proximal phalanx platform (38). Embodiments in which the thumb guide (33) is a separate piece are also contemplated such as, for example, the embodiments discussed above wherein the thumb guide (33) is bonded, welded or bolted to the knife base.

In certain embodiments, thumb retaining area (37) may have a texturized or stippled surface to increase the coefficient of friction of the blade where contacted by the user's thumb and aid the user in gripping the knife and preventing the user's thumb from slipping. The texturized or stippled surface may be stamped onto thumb retaining area (37) or otherwise formed during the manufacturing process. However, in other embodiments, thumb retaining area (37) prevents any finger movement on the blade without the need for any texturized or stippled surface.

Figure 3C:
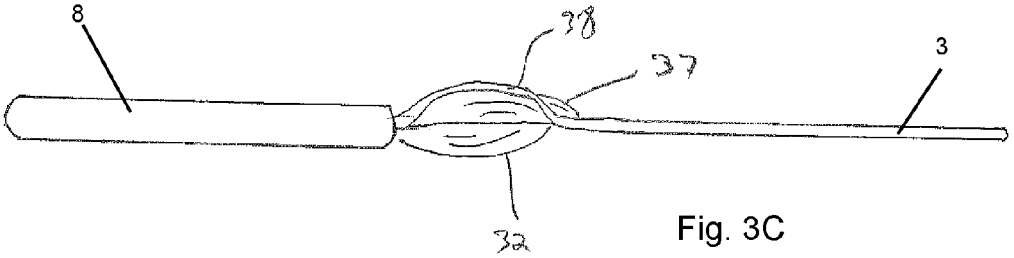
FIG. 3C is an illustration of a top view of a culinary knife having a form-fitting grip according to certain aspects of the present invention.

FIGS. 3A and 3B illustrate, in respective side views, a culinary knife having a grip with a platform (38) for accommodating the proximal phalanx of a user's forefinger, according to certain aspects of the present invention. FIGS. 3C and 3D also illustrate, in a top view and a front view, respectively, a culinary knife having a grip with a platform (38) for accommodating the proximal phalanx of a user's forefinger, according to certain aspects of the present invention. The forefinger's proximal phalanx is the portion of the forefinger closest to the palm of the hand. As mentioned above, when a standard culinary knife is held in the chef's grip, the proximal phalanx of the user's forefinger extends across and exerts downward pressure upon the knife's spine, which makes the forefinger's proximal phalanx susceptible to blisters and sores during extended use. Platform (38) is configured to conform to the contours of the proximal phalanx of a user's forefinger, the thumb-side of which rests on or against platform (38) when the user is holding the knife in the chef's grip. The purpose of the platform (38) is designed to provide a comfortable platform for at least a portion of the forefinger's proximal phalanx to rest upon.

Due to the anatomy of the hand, and the positioning of the user's fingers in the chef's grip, proximal phalanx platform (38) is, in preferred embodiments, located on the knife spine (3) above the base (11) of the blade (as depicted in FIGS. 3A-3C). Platform (38) breaks the continuity of the knife spine and is configured to support a portion of the user's forefinger (e.g., at least a portion of the forefinger's proximal phalanx). In some embodiments, platform (38) is located below the edge of knife spine (3), while in other embodiments, platform (38) may be located above the edge of knife spine (3).

In order to be conformed to the contours of the outside surface (e.g., thumb-side surface) of the proximal phalanx of the user's forefinger, the surface of platform (38) that supports the proximal phalanx portion of the forefinger is, in certain embodiments, curved and has a concave shape or contour complementary to the forefinger's outer (e.g., convex) surface, as illustrated in FIGS. 3A, 3B and 3C. As a result, the user's forefinger comfortably rests against and upon platform (38), such as illustrated in, for example, FIGS. 4A and 4B. In some embodiments, the surface or face of platform (38) opposing the concave surface (e.g., the surface on the forehand side of the grip) may have a convex shape or curvature. The curved shape of the outer edge of platform (38) in combination with the concave curvature of the surface of platform (38) may cause platform (38) to appear similar to a half of a spoon, i.e., a spoon sliced lengthwise, a half of an oval shape, or a quadrasphere (e.g., half of a hemisphere). Other shapes are also contemplated.

In certain embodiments, as shown best in FIGS. 3C and 3D, platform (38) may extend away from the knife spine (3) towards the forehand side of the knife (the second face of the blade) and at an angle relative to the knife blade (e.g., along the knife's longitudinal axis). The angle at which platform (38) extends towards the forehand side of the knife is complementary to the angle at which the user's forefinger extends across the knife's spine when a user grips the knife with the chef's grip. In certain embodiments, the angle at which platform (38) extends towards the thumb side of the grip is approximately 30 to 70 degrees relative to a horizontal axis extending perpendicular to the longitudinal axis of the knife. In certain embodiments, platform (38) extends at an angle of approximately 45 degrees. In other embodiments, platform (38) extends at an angle of approximately 70 degrees. The angle and curvature of proximal phalanx platform (38) help ensure that the portion of the forefinger rests on the platform comfortably.

In certain embodiments, platform (38) is adapted to support the entire proximal phalanx of the user's forefinger, while the remaining portions of the forefinger, other than the proximal phalanx, rest on the first face of the blade, e.g., within forefinger guide (34). In other embodiments, platform (38) is adapted to support only a first portion of the proximal phalanx, e.g., the portion closest to the knuckle, while a second portion of the proximal phalanx and the remaining portions of the user's forefinger (other than the first and second portions of the proximal phalanx) rest on the first face of the blade, e.g., within forefinger guide (34).

In certain embodiments, platform (38) appears to be a portion of extra material (e.g., ceramic or metal) added to the knife spine that has been pushed to one side. In this embodiment, platform (38) may be formed by being stamped or indented from a thickened portion of the knife spine. In this embodiment, the area of the knife spine (3) to be stamped is thicker than other parts of the knife, and that area of the spine is stamped between a plate with a concave region and a convex "hammer" that has a complementary shape. Alternatively, platform (38) may be formed from an elongated area in the spine (3) of the blade that has been "pushed" to one side, in the manner of stamping described above. When platform (38) has been pushed towards the forehand side of the blade, as illustrated in FIGS. 3C and 3D, platform (38) serves to nestle at least a portion of the proximal phalanx of the user's forefinger.

Alternatively, platform (38) may be stamped from a separate piece of material that is then bonded or welded to the knife spine. In this embodiment, a portion of the spine (3) of the knife, e.g., in the shape of a half oval, such as a notch, may be removed or cut out from the knife spine during stamping of the knife. In addition, a concave shaped oval or quadrasphere (e.g., half of a hemisphere), e.g., in the shape of a spoon sliced lengthwise, a half of an oval shape, is formed that has an external contour that matches the portion cut out of the spine (3). The concave shaped oval is then welded or bonded to the edge of the portion the cut out of the spine (3). Alternative manufacturing methods include shaping the knife and grip out of one block of material (e.g., metal) via, for example, CNC milling, or hardening the final shape out of metal powder via 3-D printing. Other alternative manufacturing methods are contemplated.

Reference is now made to FIGS. 4A and 4B, which are illustrations of a user's hand gripping a knife via components according to certain aspects of the present invention. FIG. 4A illustrates the right-handed forehand side of a user's hand gripping the knife, and FIG. 4B illustrates the right-handed backhand side of user's hand gripping the knife, showing the positioning of certain components of the present invention such as, for example, outside forefinger guide (32), thumb guide (33), and platform (38). Inside forefinger wall (34) is not shown because it is hidden by the user's hand. As can be seen in FIGS. 4A and 4B, the user's thumb and forefinger rest adjacent to the grip components of the present invention. Each component is designed to comfortably fit the user's fingers. For example, and as discussed above, each component may have a form-fitting design adapted to securely and comfortably hold the user's fingers. As can also be seen in FIGS. 4A and 4B, the proximal phalanx part of the user's forefinger rests squarely on proximal phalanx platform (38).

As discussed above, the grip of the present invention comprises multiple components such as, inter alia, an outside forefinger guide (32), an inside forefinger guide (34), a forefinger retaining area (36), a thumb guide (33), a thumb retaining area (37), and a platform (38). In certain embodiments, each of the parts of the present invention may be manufactured as a separate piece. In other embodiments, two or more pieces may be formed as one piece. In yet other embodiments, all of the parts of the bolster grip may be made as one piece. In an alternative embodiment, a knife may begin as a block of material (e.g., a block of metal) initially having thickened dimensions and may be sculpted, milled, forged or stamped into a knife having the grip components of the present invention.

In yet another alternative embodiment, a knife may initially have slightly thickened dimensions and a more pronounced taper beginning at a thickened knife spine and tapering to a thin cutting edge of the knife blade. Areas on each face of the blade may be ground out of the knife blade, which are slightly thicker than normal, thereby forming forefinger retaining area (36) and thumb retaining area (37). This embodiment may not include the guides discussed above and may include only the forefinger retaining area and the thumb retaining area. In certain embodiments, forefinger retaining area (36) and thumb retaining area (37) may have a texturized or stippled surface, as discussed above, to aid the user in gripping the knife and prevent the user's fingers from slipping.

In certain embodiments, the grip of the present invention may be manufactured as an integral part of the knife (e.g., on the knife blade and/or spine), while, in other embodiments, the grip may be manufactured separately from the knife and subsequently attached to the knife blade and/or knife spine. In the embodiments where the grip is formed separately, the grip may be permanently added to the knife blade or spine later such as with, for example, welding, fusing, screws or rivets. In other embodiments, the grip of the present invention may be a removable grip that may be moved easily from tool to tool or from knife to knife.

In most embodiments, the grip of the current invention is asymmetrical (e.g., is chiral) due to that asymmetrical nature of the hand. It is contemplated that the grip of the present invention may be manufactured to be specific for users who use their right or their left hand when holding a knife, and an asymmetric version of the grip may designate the grip as either a right-handed grip or a left-handed grip. FIGS. 3 and 4 herein show the grip in a right-handed asymmetric version thereof, although a left-handed asymmetric version thereof is similarly contemplated by reversing the structures.

A symmetric version of the grip is possible. It is also contemplated that the grip of the present invention may be manufactured in an ambidextrous version, i.e., to allow users who use either or both their right or their left hand when holding a knife to use this grip. For example, a symmetric version may designate the bolster grip as ambidextrous.

It will be evident to those skilled in the art that the invention is not limited to the details of the foregoing illustrative embodiments and that the present invention may be embodied in other specific forms without departing from the spirit or essential attributes thereof.

The embodiments presented herein are, therefore, to be considered in all respects as illustrative and not restrictive of the scope of the invention, and the skilled artisan will appreciate the appropriate equivalents thereto, which are to be considered as part of this invention.

The invention claimed is:

1. A knife, the knife characterized by a handle, a blade having a first face and a second face opposing said first face, a blade spine, a blade tip, and a blade edge, said blade comprising:

on the first face of the blade, a first forefinger guide, a second forefinger guide, and a first area formed between the first and second forefinger guides and configured to retain a first portion of a forefinger of a user, wherein the second forefinger guide has a curved shape that is concave in a direction facing the blade edge and convex in a direction facing the blade spine;

on the second face of the blade, a thumb guide and a second area configured to retain a thumb of the user; and a platform located on the blade spine, said platform being configured to support a second portion of the forefinger of the user.

2. The knife according to claim 1, wherein the first forefinger guide and the second forefinger guide extend laterally away from a surface of the blade.

3. The knife according to claim 1, wherein the first forefinger guide and the second forefinger guide surround the first area.

4. The knife according to claim 1, wherein the first forefinger guide has a curved shape.

5. The knife according to claim 4, wherein the curved shape of the first forefinger guide is concave in a direction facing the handle and convex in a direction facing the blade tip.

6. The knife according to claim 4, wherein the curved shape of the first forefinger guide is configured to conform to a contour of an outer surface of the first portion of the forefinger.

7. The knife according to claim 1, wherein the second forefinger guide is located adjacent to the first forefinger guide in a direction towards the handle, and is separated from the first forefinger guide by a gap.

8. The knife according to claim 1, wherein the curved shape of the second forefinger guide is configured to conform to a contour of an inside surface of the first portion of the forefinger.

9. The knife according to claim 1, wherein the first forefinger guide and the second forefinger guide form a continuous structure.

10. The knife according to claim 1, wherein the first area has a curved surface configured to conform to a contour of an outside surface of the first portion of the forefinger.

11. The knife according to claim 1, wherein the thumb guide extends laterally away from a surface of the blade.

12. The knife according to claim 1, wherein the thumb guide has a curved shape.

13. The knife according to claim 12, wherein the curved shape of the thumb guide is concave in a direction facing the handle and convex in a direction facing the blade tip.

14. The knife according to claim 12, wherein the curved shape of the thumb guide is configured to conform to a contour of an outside surface of the thumb.

15. The knife according to claim 1, wherein the first forefinger guide, the second forefinger guide, the first area, the thumb guide, the second area, and the platform are formed as one piece.

16. The knife according to claim 1, wherein the first and second areas comprise a texturized or stippled surface.

17. A knife, the knife characterized by a handle, a blade having a first face and a second face opposing said first face, a blade spine, a blade tip, and a blade edge, said blade comprising:

on the first face of the blade, a first forefinger guide, a second forefinger guide, and a first area formed between the first and second forefinger guides and configured to retain a first portion of a forefinger of a user;

on the second face of the blade, a thumb guide and a second area configured to retain a thumb of the user; and a platform located on the blade spine, said platform being configured to support a second portion of the forefinger of the user, wherein the platform extends at an angle in a direction towards the second face of the blade.

18. The knife according to claim 17, wherein the platform has a curved surface configured to conform to a contour of the second portion of the forefinger.

19. The knife according to claim 17, wherein the platform breaks the continuity of the blade spine.

20. A knife, the knife characterized by a handle, a blade having a first face and a second face opposing said first face, a blade spine, a blade tip, and a blade edge, said blade comprising:

on the first face of the blade, a first forefinger guide, a second forefinger guide, and a first area formed between the first and second forefinger guides and configured to retain a first portion of a forefinger of a user;

on the second face of the blade, a thumb guide and a second area configured to retain a thumb of the user; and a platform located on the blade spine, said platform being configured to support a second portion of the forefinger of the user, wherein the first and second areas comprise indentations into the first face and the second face of the blade.

21. A knife comprising:

a handle;

a blade having a first face and a second face opposing said first face;

a blade spine;

a blade tip; and a grip, said grip comprising:

a forefinger grip located on the first face of the blade, said forefinger grip comprising a first forefinger guide, a second forefinger guide, and a first area formed between the first and second forefinger guides and configured to retain a first portion of a forefinger of a user;

a thumb grip located on the second face of the blade, said thumb grip comprising a thumb guide and a second area configured to retain a thumb of the user; and a forefinger platform located on the blade spine, said forefinger platform configured to support a second portion the forefinger of the user, wherein the platform extends at an angle in a direction towards the second face of the blade.

* * * * *